United States Patent [19]

Larabie

[11] Patent Number: 4,630,592

[45] Date of Patent: Dec. 23, 1986

[54] WOOD STOVE

[76] Inventor: Ludger Larabie, R.R. 2, Kapuskasing, Ontario, Canada, P5N 2X8

[21] Appl. No.: 748,220

[22] Filed: Jun. 24, 1985

[51] Int. Cl.[4] ..... F24C 1/14

[52] U.S. Cl. ..... 126/4; 126/62; 126/72; 126/109

[58] Field of Search ..... 126/152 R, 152 B, 164, 126/163 R, 72, 4, 70, 71, 109, 106, 100, 58, 62, 120, 121

[56] References Cited

U.S. PATENT DOCUMENTS

| | | | |
|---|---|---|---|
| 1,045,348 | 11/1912 | Witt | 126/4 |
| 1,958,761 | 5/1934 | McNary | 126/121 |
| 2,618,256 | 11/1952 | Olson | 126/109 |
| 4,230,090 | 10/1980 | Darnell | 126/121 |

FOREIGN PATENT DOCUMENTS

| | | | |
|---|---|---|---|
| 155216 | 4/1912 | Canada | 126/121 |
| 176872 | 5/1917 | Canada | 126/121 |
| 3730 | 7/1974 | Canada | 126/121 |
| 1287780 | 1/1969 | Fed. Rep. of Germany | 126/121 |
| 867124 | 10/1941 | France | 126/72 |

*Primary Examiner*—James C. Yeung

[57] ABSTRACT

The heating stove comprises from top to bottom, a smoke space, an oven, a combustion chamber and an ash-pit; a grate separates the chamber from the ash-pit. The grate comprises a plurality of open-ended hollow cylindrical metallic ducts which criss-cross so as to form a X and which open outwardly of the stove for heating ambient air circulating therethrough. Each of the ducts has a substantially-flattened crossing portion, in order to reduce the spacing between the tubes. The grate may support a solid combustible, but permit the ashes to drop into the ash-pit between the ducts. A plurality of upright semi-cylindrical tubes are fixed to the sides of the oven and form passages between the combustion chamber and the smoke space. The oven is heated not only at its bottom but along its side walls and the tubes also serve to heat the ambient air.

4 Claims, 5 Drawing Figures

WOOD STOVE

FIELD OF THE INVENTION

This invention relates to heating stoves.

BACKGROUND OF THE INVENTION

Patents on wood-burning stoves are found at dates as early as in 1874, with the Canadian Pat. No. 3,730. Throughout the other patents which exist in this field, there are the Canadian Pat. Nos. 155,216 and 176,872 and the U.S. Pat. Nos. 406,955 (dated 1889); 610,795; 1,707,096; 2,475,120; 4,127,100; and 4,230,090.

There are found in these patents a stove comprising a combustion chamber, an oven, an ash-pit, a grate made of hollow ducts assembled into a X and which open outwardly at each end, but such features do not appear concurrently.

These patents, nevertheless, present several disadvantages. Canadian Pat. No. 155,216 shows a somewhat rudimentary stove, whose minimum dimensions are too large. The walls of this stove are also susceptible of shortly warping under the warp-inducing heat produced by the combustion of wood or other, even if they are covered by an asbestos lining.

In U.S. Pat. No. 4,230,090, the ducts constituting the sides of the stove are of a small energetic efficiency, since they sustain heat losses due to their construction. To empty the ashes from the stove, one must wait that the stove be cold. The cleaning frequency would tend to be high and the cleaning is difficult in view of its access. Furthermore, this stove has no oven. The door of the combustion chamber is so low that one needs to kneel in order to position the combustible, an unpleasant operation.

In Canadian Pat. No. 176,872, the part of the stove below the grate must be cold, since it can stand directly on the ground without any legs. The calorific efficiency is thus smaller. The upper part of the stove is made of passageways of varied shapes where all the soot residues may accumulate, rendering this stove of a problematic maintenance.

OBJECTS OF THE INVENTION

The gist of the invention is to increase the energetic efficiency of the heating stoves.

Another object of the invention is to disclose a stove which will occupy a small volume, yet will be at the same time of simple and economical construction.

A supplemental object of the invention is to disclose a stove as above described, for which maintenance will be greatly facilitated and the frequency of maintenance of which is greatly reduced.

Still another object of the invention is to include an oven in the above-described stove, which will permit a thoroughly even cooking of the foodstuff placed therewithin.

SUMMARY OF THE INVENTION

According to the invention, the heat stove comprises, from top to bottom, a flue, a smoke space, a cooking oven, a combustion chamber and an ash-pit. A grate separates the chamber from the ash-pit.

The grate comprises a plurality of hollow cylindrical metallic ducts, which criss-cross so as to form an >>X<< and which open outwardly at each end outside the stove. Each of these ducts has a flattened crossing portion, in order to decrease the spacing between the remaining portions of the ducts. Ambient air can circulate through the ducts to thus become heated.

The grate may support a solid combustible during its combustion, but allows the ashes to drop between the ducts in the ash-pit.

The sides of the cooking oven are provided with a plurality of semi-cylindrical upright pipes projecting from said sides and forming passages for the combustion gases from the combustion chamber to the smoke space. The combustion flames that lick the bottom and the sides of the oven permit an even cooking of a product placed inside the oven.

The semi-cylindrical pipes also increase the effective heat-exchange area of the stove relative to ambient air.

DETAILED DESCRIPTION OF THE PREFERRED EMBODIMENT OF THE INVENTION

Figure 1:
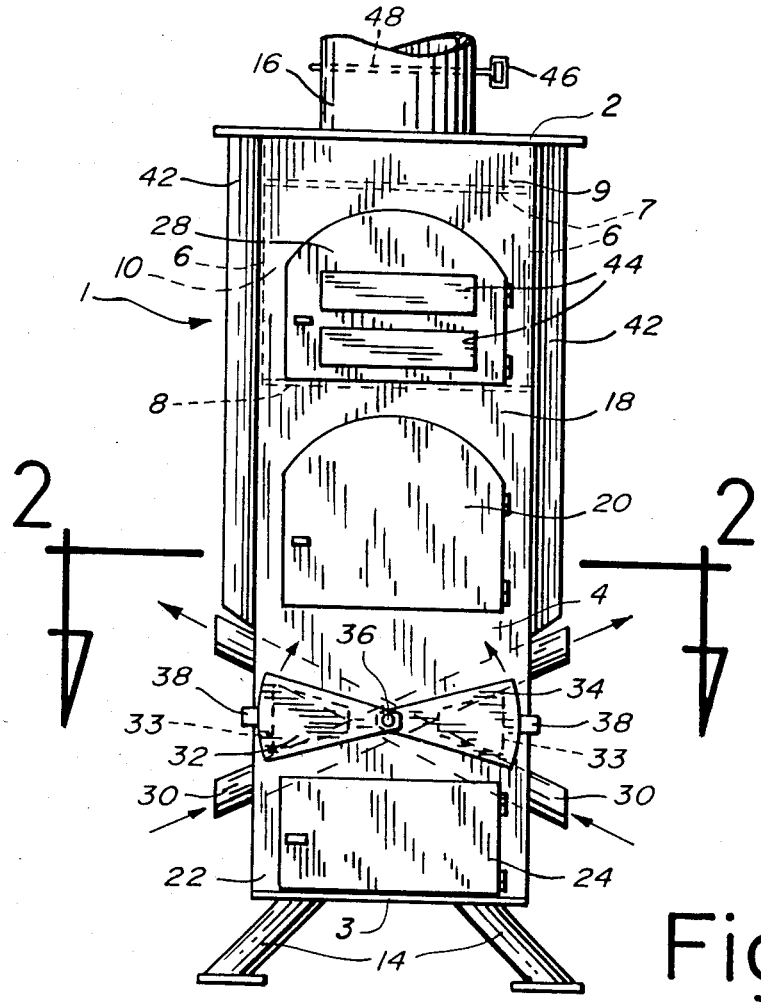
FIG. 1 shows a front elevation of a preferred embodiment of the wood stove according to the invention.
Figure 2:
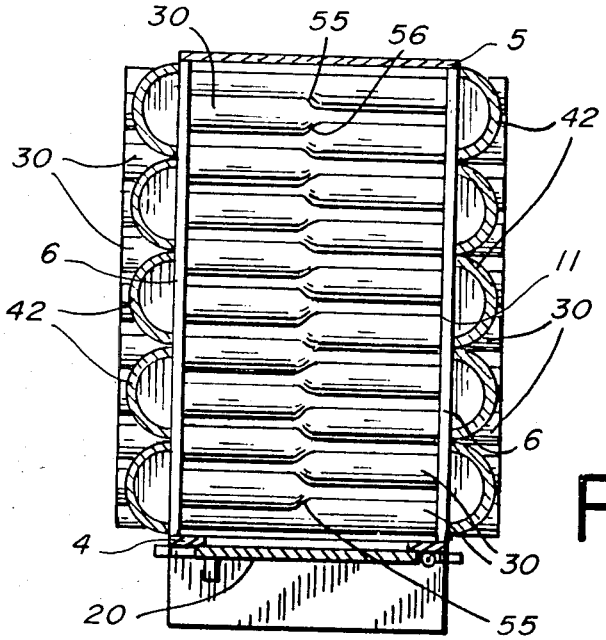
FIG. 2 shows a cross-section taken along line 2—2 of FIG. 1.

The stove, denoted by 1, forms an enclosure of rectangular cross-section including a top wall 2, a bottom wall 3, front wall 4, a back wall 5 and side walls 6. Upper and lower vertically-spaced partitions 7 and 8 extend within the enclosure, fixed to the walls 4, 5, and 6 and parallel to top wall 2. A smoke space 9 is defined between top wall 2 and upper partition 7. A cooking oven 10 is defined between upper and lower partitions 7 and 8. A combustion chamber 18 is defined below partition 8 and is accessible by the door 20; an ash-pit 22 is under the combustion chamber 18 and accessible by another door 24. The cooking oven 10 is accessible by another door 28.

The chamber 18 is separated from ash-pit 22 by a grate consisting of a plurality of hollow metallic ducts 30 which criss-cross at the center of the stove to form an X figure and which extend through and are fixed to side walls 6 and open outwardly at each end. Two triangular exterior flaps 32, 34 are pivoted to front wall 4 and one to the other at their apex at a pivot point 36 corresponding to the criss-crossing center of ducts 30 and comprise tongues 38 allowing the progressive closing or opening of the stove air intakes 33.

A plurality of vertical semi-cylindrical pipes 42 project from and are secured to both side walls 6. Pipes 42 communicate with chamber 18 through side wall openings 11 and with smoke space 9 through similar side wall openings. The oven door 20 comprises at least one, preferably two rocker flaps 44, which may be open to let the heat out of the oven.

To the flue is added a control handle 46 controlling a damper 48, so as to control combustion gas escape from the combustion chamber 18 through pipes 42.

Figure 3:
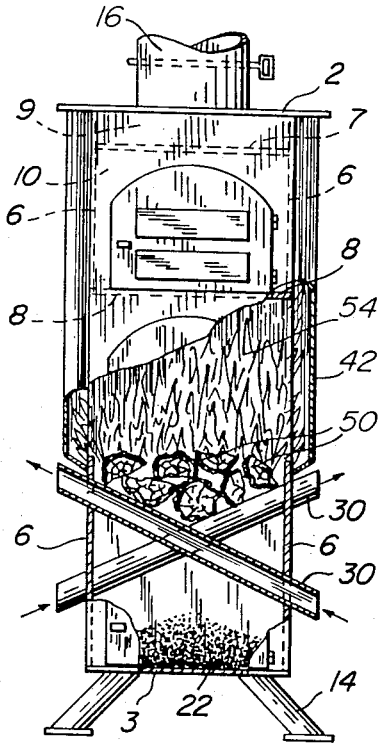
FIG. 3 is a partial vertical section of the view of FIG. 1.
Figure 4:
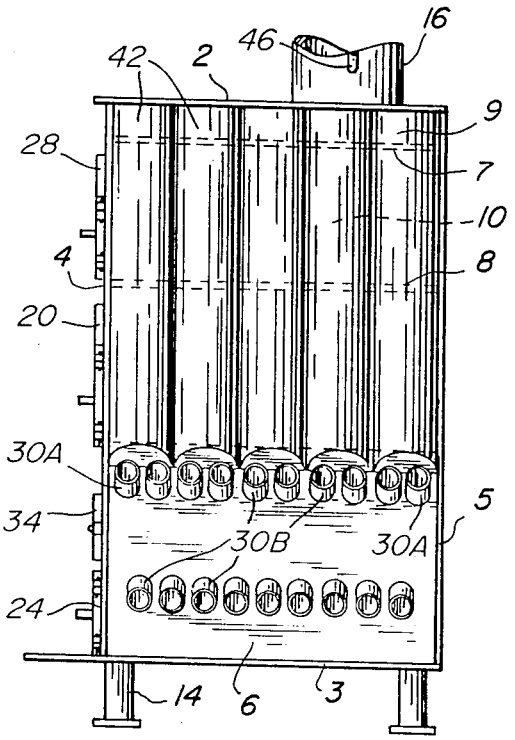
FIG. 4 is a side elevation of the said wood stove.

A look at FIGS. 3 and 4 shows that the ducts 30 are designed to support a solid combustible, wood logs 50, as illustrated, and thus to define a grate. The ashes 52, which are thus produced by logs 50, may infiltrate in between the ducts 30 and fall under gravity into the ash-pit 22. The flames 54 produced by logs 50 will lick the base and the sides of oven 10, whereas smoke will be able to escape by flue 16.

Figure 5:
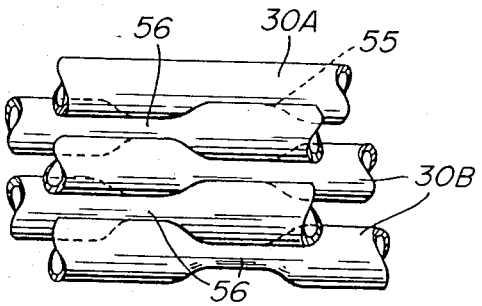
FIG. 5 is an enlarged view of the portions of ducts which criss-cross in the stove.

A characteristic of ducts 30 is shown at FIGS. 4 and 5. According to the invention, two types of ducts 30 will be necessary: cylindrical ducts 30A having a criss-crossed portion flattened at one side only, at 55, and cylindrical ducts 30B having a criss-crossed portion flattened on the two opposite sides, at 56. It will be understood that numeral 30A relates to the duct at each end of the grate, whereas all other ducts are 30B.

The flattenings 55, 56 allow to maintain the grate assembly in a very stable fashion, yet without hampering air circulation through ducts 30. It also allows the decrease of free space in between ducts 30, so as to retain the burning firebrands, yet allowing therethrough the ashes and also combustion air in between the upper legs of the X.

FIGS. 1 and 3 do show that ambient air will naturally have the tendency to engage through the lower end of ducts 30 and to escape therefrom by their upper ends. Since the cinders are located at the base of the grate, ducts 30 become extremely hot and air which passes temporarily therethrough becomes rapidly hot by convection.

A stove 10 as above described provides a thirty percent higher calorific efficiency than stoves available on the market, as of the date of conception of the present invention. There are found furthermore numerous unique advantages in the said present invention.

For example, the ash-pit 22 may be emptied and cleaned independently of the existence or not of a fire. The grate being constituted of cylindrical non-horizontal ducts, combustion debris will not adhere thereon, and, thus, the grate will always remain clean; maintenance thus becomes facilitated and of a low frequency. The semi-cylindrical shape of pipes 42 increases the stove area and, thus, its heat dispersion capacity. The combustion air intake may be controlled by tongues 38 and, thus, the duration of combustion as well as the level of production of heat may vary with the need therefor. The stove 10 is of such a shape that its walls will resist the heat-induced distortion thereof; it is not necessary to place side by side an asbestos lining or firebricks to the walls.

Such a stove may be useful as an alternate heating system, which may become handy during a Canadian winter when the electricity supply failure extends for a long period of time, since the conventional oil- and gas-heating systems are dependent on electricity for the operation thereof, as is well known.

Furthermore, since the flames of the fire lick the base and the sides of oven 10, the cooking of foodstuff therewithin will thus be completely even.

What I claim is:

1. A stove comprising an enclosure having a front wall, a rear wall, top and bottom walls, and two side walls, a smoke outlet made in said top wall, an upper and a lower partition fixedly mounted to said walls in vertically-shaped relationship within said enclosure, intermediate and parallel to said top and bottom walls, a smoke space, and a cooking oven space being defined above said upper partition and between said upper and lower partitions, respectively, a grate extending within said enclosure intermediate said lower partition and said bottom wall, a combustion chamber and an ash-pit being defined above and below said grate, respectively, an air intake for said combustion chamber, said grate comprising a plurality of hollow cylindrical metallic ducts, which criss cross in order to form an X and which open outwardly at each end, the ends of each duct extending through and fixed to said side walls permitting the ambient air to circulate through said ducts; each of said ducts having an intermediate crossing portion that is substantially flattened, said grate being able to support a solid combustible, yet allowing therethrough by gravity the cinders into said ash-pit; a plurality of lateral semi-cylindrical upright pipes closed at both ends and fixedly secured to and projecting from the exterior face of each of said side walls between said top wall and the outer ends of said ducts, said side walls having first and second openings making communication between said combustion chamber and said pipes and between the latter and said smoke space, respectively.

2. The stove as defined in claim 1, wherein said air intake comprises intake control means consisting of two triangular flaps covering said air intake and pivoted to said stove and to one another at their apex at a pivotal point corresponding to the criss-crossing center of the ducts, and tongues integral to said flaps and permitting to close or open said air intake in a progressive fashion.

3. The stove as defined in claim 1, wherein said cooking oven comprises an access door having at least one rocker flap permitting the progressively-increasing production of heat outwardly therefrom.

4. The stove as defined in claim 1, wherein the crossing portion of the said ducts is flattened at both opposite sides of the duct, except for the two ducts at each end of said grate for which the crossing portion is flattened on a single side.

* * * * *